United States Patent [19]

Schramm

[11] Patent Number: 4,669,191

[45] Date of Patent: Jun. 2, 1987

[54] PAPER PERFORATING DEVICE

[76] Inventor: William G. Schramm, 6299 Tanglewood Ave., Grand Blanc, Mich. 48439

[21] Appl. No.: 730,845

[22] Filed: May 6, 1985

[51] Int. Cl.[4] ..... B26F 1/32

[52] U.S. Cl. ..... 30/358; 29/513; 29/437; 30/366; 83/620; 83/660

[58] Field of Search ..... 83/620, 660; 30/358, 30/360, 361, 366, 368; 403/112, 376, 280, 281, 336, 397; 29/513, 437

[56] References Cited

U.S. PATENT DOCUMENTS

| | | | |
|---|---|---|---|
| 1,203,436 | 10/1916 | Thompson | 83/660 |
| 1,505,775 | 8/1924 | Gail . | |
| 1,936,783 | 11/1933 | Chase | 30/358 |
| 2,601,108 | 6/1952 | Emmer | 83/620 |
| 2,782,856 | 2/1957 | Staley | 164/120 |
| 3,147,658 | 9/1964 | Boyd | 83/660 |
| 3,303,564 | 2/1967 | Hendricks | 30/358 |
| 3,334,809 | 8/1967 | Zajic et al. | 30/358 |
| 3,748,737 | 7/1973 | Duff et al. | 30/358 |
| 3,859,726 | 1/1975 | Mitsunari | 30/358 |
| 3,906,633 | 9/1975 | Inoue | 30/358 |
| 3,921,487 | 11/1975 | Otsuka et al. | 83/620 |
| 3,944,373 | 3/1976 | Farjon et al. | 402/1 |
| 3,975,105 | 8/1976 | Cline | 402/1 |
| 4,020,554 | 5/1977 | LaTourette | 30/358 |

*Primary Examiner*—Frank T. Yost
*Assistant Examiner*—Hien H. Phan
*Attorney, Agent, or Firm*—Gifford, Groh, VanOphem, Sheridan, Sprinkle and Dolgorukov

[57] ABSTRACT

A paper perforating device for creating a series of linearly aligned perforations the length of a sheet of paper. The invention includes a lower member with a series of linearly aligned openings and an upper member with a corresponding number of linearly aligned teeth. Upon engagement, the teeth travel through the openings thereby piercing the paper. The invention also includes a pair of slot-engaging tabs which limit the distance the upper and lower members may travel relative to one another.

13 Claims, 6 Drawing Figures

PAPER PERFORATING DEVICE

BACKGROUND OF THE INVENTION

I. Field of the Invention

This invention relates to paper piercing tools and, in particular, to a device for piercing a series of perforations the length of a sheet of paper.

II. Description of the Prior Art

Perforation of paper has long been known as a simple way of providing means for storing and removing a single sheet of paper from its binding without creating unsightly tears. In the past, perforations have been provided by the manufacturer of the sheet paper to permit storage and removal of each individual sheet without creating unsightly tears or requiring additional tools. However, these perforations were usually done in bulk quantities during the manufacturing process in order to permit storage of the paper in ring binders. For many years, no means were provided whereby an individual user could easily and efficiently create perforations suitable for storage of the paper.

There have, however, been previously known devices which allow an individual to create a series of punches in a sheet of paper. These devices range from the single-hole punch, which require repetitive strokes in order to create a series of punches, to the two-, three-, and five-hole punches, which are similarly limited in their use. In order to create a series of perforations along the length of a sheet of paper, the punch would have to be used several times along the length of the paper. Furthermore, when the device is removed and the paper re-punched, oftentimes an uneven series of holes is produced Moreover, many of these multipunch devices are strictly limited in the number of sheets and the paper size which may be utilized and the placement of the perforations.

Perforated paper has also been formed into books by binding the separate sheets of paper utilizing conventional materials. The most common method of binding books utilizes string or similar material threaded through the perforations to secure the center of the perforated sheets. However, the perforations were usually formed by the manufacturer utilizing complex machinery before binding the sheets of paper. Previously known devices are generally either incapable of efficiently perforating the center of a sheet of paper in order to permit binding or involve complex machinery which is unsuitable and uneconomical for individual users.

SUMMARY OF THE PRESENT INVENTION

The present invention overcomes the disadvantages of the prior art by providing a device which is capable of punching a series of linearly aligned perforations in a single stroke beyond the immediate edge of the paper thereby permitting several sheets of paper to be bound together along their center to form a book-like product. The sheets of paper may be bound together by any number of simple means including string, cord, thread, or any similar material.

In the preferred embodiment the device comprises two elongated and substantially U-shaped members. The upper member includes a plurality of linearly aligned teeth which extend along the length of one surface of the upper member. Alignment of the teeth along the intended perforation path is accomplished by viewing the paper through the openings of the teeth.

Alternatively, a pair of notches may be included at each end of the upper member to indicate the path of the linearly aligned teeth.

The lower member includes a corresponding number of linearly aligned holes which are designed to receive the teeth from the upper member. A pair of tabs located at opposite ends of the one surface of the lower member are received through corresponding slots in the surface of the upper member in order to align the upper and lower members to each other.

In use, sheets of paper are placed between the upper and lower members such that the desired alignment of the perforation lies beneath the teeth. Once in place, the upper member is pressed down to force the teeth through the paper and through the corresponding holes in the lower member. The tab within the slot limits the distance that the two members can separate but permits simple removal and replacement of paper while preventing a user from inadvertently placing their finger between the upper and lower members and causing serious injury.

The present invention creates a series of linearly aligned perforations which are equally spaced and large enough to accept a simple binding means, such as yarn or string. Thus, the present invention provides a simple and safe device which may be utilized to bind several sheets of paper into a book-like package.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views and in which.

DETAILED DESCRIPTION OF THE PREFERRED EMBODIMENT

Figure 1:
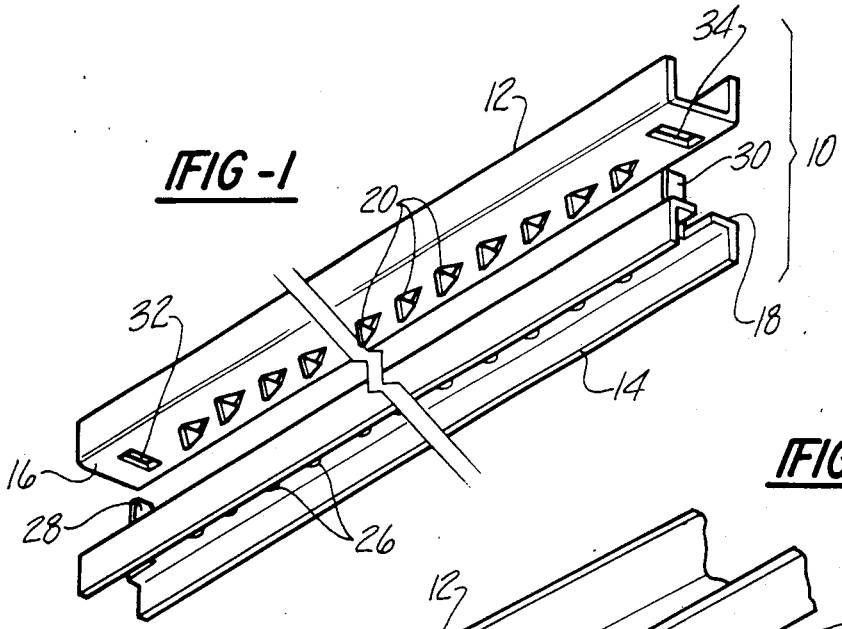
FIG. 1 is a perspective view of the preferred embodiment of the present invention.
Figure 2:
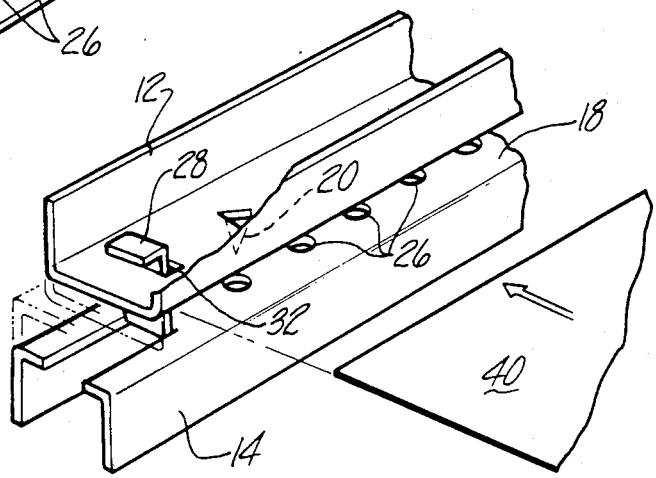
FIG. 2 is a perspective view of one end of the preferred embodiment.

Referring to FIGS. 1 and 2, there is shown a device 10 embodying the present invention and comprising an elongated upper member 12 and an elongated lower member 14. Both upper member 12 and lower member 14 are preferably U-shaped in cross-section and include facing surfaces 16 and 18, respectively.

Figure 5:
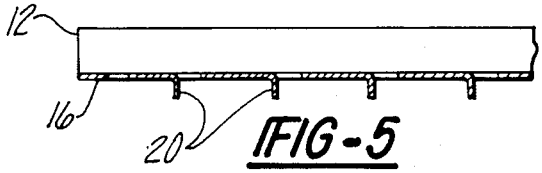
FIG. 5 is a side view of the upper member substantially along lines 5—5 of FIG. 4.

Referring to FIGS. 1, 2 and 5, a plurality of linearly aligned and evenly spaced teeth 20 protrude outwardly from and extend along the length of surface 16. Preferably, these teeth 20 are created by bending a small, triangular section of the upper member 12 outwardly from said surface 16. Alternatively, the teeth 20 can be welded or otherwise attached to the member 12.

Figure 4:
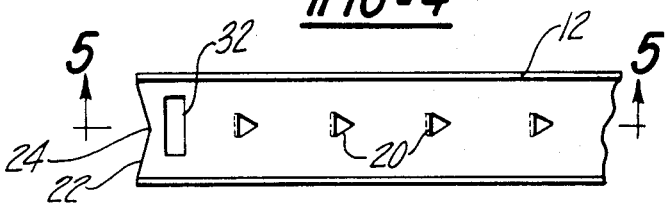
FIG. 4 is a top view of the upper member of an alternative embodiment.

In the preferred embodiment, the perforation path may be viewed through the openings in the upper member 12 created while forming the teeth 20. However, alternatively a pair of triangular notches 22, as best shown in FIG. 4, may be utilized to align the perforation. The apex 24 of these notches 22 are in alignment with the teeth 20.

As is best shown in FIG. 2, a plurality of linearly aligned holes or openings 26 are formed through and extend along the length of the surface 18 of the lower member 14. The number and spacing of the openings 26 corresponds to the number and spacing of the teeth 20 on the upper member 12.

Figure 6:
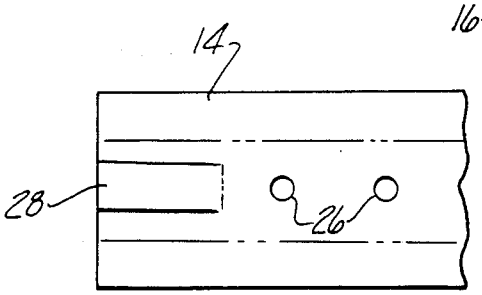
FIG. 6 is a top view of the lower member of the preferred embodiment.

Referring again to FIGS. 1, 2 and 6, a pair of tabs 28 and 30 are stamped from the opposite ends of the lower member 14 and bent from the position shown in FIG. 6 and to the position shown in FIG. 1 so that the tabs 28 and 30 extend perpendicularly from the surface 18. However, as an alternative, these tabs may be welded or otherwise attached to the lower member 14. The tabs 28 and 30 register with tab-engaging slots 32 and 34 located at opposite ends of the upper member 12 and maintain the surfaces 16 and 18 parallel to each other.

Referring to FIG. 2, the tabs 28 and 30 are inserted through the tab engaging slots 32 and 34. After the tabs 28 and 30 are inserted through the slots 32 and 34, the tabs 28 and 30 are bent thus attaching the members 12 and 14 together while still permitting limited travel between the members 12 and 14 between a first position in which the surfaces 16 and 18 are spaced apart from each other and a second position in which the surfaces 16 and 18 are closely adjacent each other.

Figure 3:
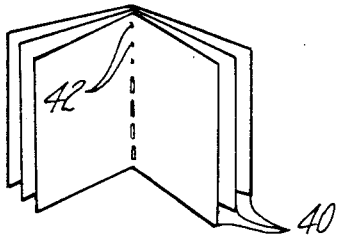
FIG. 3 is an example of the perforation created by the present invention and the bound sheets of paper.

In use, one or more sheets of paper 40 are placed between the upper member 12 and the lower member 14. The triangular notches 22 corresponding to the teeth 20 and openings 26 are aligned along the desired perforation line and upper member 12 is then pressed against the lower member 14 thus forcing the teeth 20 through the paper 40 and forming the perforations 42 (FIG. 3). The upper member 12 is then raised and the sheet or sheets of paper 40 are removed from in between the members 12 and 14.

From the foregoing, it can be seen that the perforating device 10 of the present invention provides a simple and economical means for creating a series of linearly aligned perforations the length of a sheet of paper. Because of its simple design, the device can be utilized by children to create homemade books consisting of a plurality of standard sheet paper and yarn or string to bind the sheets together.

Having described my invention, many modifications thereto will become apparent to those skilled in the art without deviation from the spirit of the invention as defined by the scope of the appended claims.

I claim:

1. A paper perforating device comprising:

an elongated upper member with a substantially planar surface;

an elongated lower member with a substantially planar surface;

means for slidably securing said upper to said lower members so that said surfaces face each other and so that said members are movable between a first position in which said surfaces are spaced apart from each other and a second position in which said surfaces are closely adjacent each other; and means for piercing a sheet of paper positioned between said surfaces when said members are moved from said first postiion an to said second position;

wherein said securing means comprises at least two slots at opposite ends of said surface on said upper member and at least two slot engaging tabs extending perpendicular to said lower member surface at opposite ends of said lower member.

2. The innvetion as defined in claim 1 wherein said means for piercing comprises a plurality of linearly aligned, equally spaced teeth extending from said surface on said upper member and a corresponding plurality of linearly aligned, equally spasced openings in said surface on said lower member.

3. The invention as defined in claim 2 wherein said teeth are triangular in shape.

4. The invention as defined in claim 2 wherein said upper member and said teeth are of a one piece construction.

5. The invention as defined in claim 4, wherein said teeth are triangular in shape and stamped from said upper member.

6. The invention as defined in claim 1 wherein said securing means comprises means for maintaining said surfaces substantially parallel to each other.

7. The invention as defined in claim 1 wherein said upper and lower members are substantially equal in length.

8. The invention as defined in claim 1, wherein said tabs limit the distance between said planar surfaces when said members are in said first spaced apart position.

9. The invention as defined in claim 8, wherein said device is manually operable and the distance limited by said tabs is sufficiently small to prevent the inadvertent placing of a manipulant's finger between said upper and lower members.

10. The invention as defined in claim 1, wherein said tabs are stamped from said lower member.

11. The invention as defined in claim 1, wherein said elongated members are substantially U-shaped in cross section.

12. A manually operable paper perforating device comprising:

an elongated upper member having a substantially planar surface;

an elongated lower member having a substantially planar surface and having a length substantially equal to that of said elongated upper member;

means for slidably securing said upper member to said lower member so that said member surfaces face each other, and so that said members are movable between a first position in which said surfaces are spaced apart from each other and a second position in which said surfaces are closely adjacent each other; and means for piercing a sheet of paper which is positioned between said surfaces while said members are manually moved from said first position and to said second position;

wherein said elongated members are substantially U-shaped in cross section and said member surfaces are substantially parallel to one another;

wherein said securing means comprises a pair of slots formed one each at opposite ends of the surface of said upper member and a pair oif slot-engaging tabs stamped from and extending perpendicularly from the surface of said lower member;

wherein said piercing means comprises a plurality of linearly aligned, equally spaced trahagular teeth stamped from and extending from the upper surface of said member, and a registering plurality of linearly algned, equally spaced openings in the surface of said lower member; said piercing means being disposed between said slots and said engaged tabs; and wherein said tabs limit the distance between said planar surfaces when said members are in said first position to a distance sufficiently small to prevent the inadvertent placing of a manipulant's finger between said upper and lower members.

13. A manually operable paper perforating device essentially consisting of:

an elongated upper member having a substantially planar surface;

an elongated lower member having a substantially planar surface and having a length substantially equal to that of said elongated upper member;

means for slidably securing said upper member to said lower member so that said member surface face each other, and so that said members are movable between a first position in which said surfaces are spaced apart from each other and a second position in which said surfaces are closely adjacent each other; and means for piercing a sheet of paper which is positioned between saidd surfaces while said members are manually moved from said first position and to said second position;

wherein said elongated members are substantially U-shaped in cross section andd said member surfaces are substantially parallel to one another;

wherein said securing means comprises a pair of slots formed one each at opposite ends of the surface of said upper member and a pair of slot-engaging tabs stamped from and extending perpendicularly from the surface of said lower member;

wherein said piercing means comprises a plurality of linearly aligned, equally spaced triangular teeth stamped from and extending from the upper surface of said member, and a registering plurality of linearly aligned, equally spaced openings in the surface of said lower member; said piercing means being disposed between said slots and said engaged tabs; and wherein said tabs limit the distance between said planar surfaces when said members are in said first position to a distance sufficiently small to prevent the inadvertent placing of a manipulant's finger between said upper and lower members.

* * * * *

UNITED STATES PATENT AND TRADEMARK OFFICE

CERTIFICATE OF CORRECTION

PATENT NO. : 4,669,191

DATED : June 2, 1987

INVENTOR(S) : William G. Schramm

It is certified that error appears in the above-identified patent and that said Letters Patent is hereby corrected as shown below:

Claim 2, line 1, delete "invetion" and insert --invention--;

Claim 2, line 5, delete "spasced" and insert --spaced--;

CLaim 12, line 60, delete "oif" and insert --of--;

Claim 12, line 67, delete "algned" and insert --aligned--;

Claim 13, line 4, delete "andd" and insert --and--.

Signed and Sealed this

Twenty-seventh Day of October, 1987

*Attest:*

DONALD J. QUIGG

*Attesting Officer*

*Commissioner of Patents and Trademarks*